United States Patent [19]

San Clemente

[11] 4,172,006

[45] Oct. 23, 1979

[54] METHOD OF DELIGNIFYING WOOD CHIPS WITH OXYGEN BY ADDING COOKING LIQUOR UNDER PRESSURE

[75] Inventor: Marion R. San Clemente, Seattle, Wash.

[73] Assignee: Weyerhaeuser Company, Tacoma, Wash.

[21] Appl. No.: 900,032

[22] Filed: Apr. 25, 1978

Related U.S. Application Data

[63] Continuation of Ser. No. 717,957, Aug. 26, 1976, abandoned, which is a continuation-in-part of Ser. No. 646,809, Jan. 5, 1976, abandoned.

[51] Int. Cl.[2] ..... D21C 1/08; D21C 3/02; D21C 3/04

[52] U.S. Cl. ..... 162/65; 162/50; 162/76; 162/90

[58] Field of Search ..... 162/50, 65, 90, 76; 8/111

[56] References Cited

U.S. PATENT DOCUMENTS

| | | | |
|---|---|---|---|
| 1,831,032 | 11/1931 | Richter | 162/65 |
| 1,987,195 | 1/1935 | Kipper | 162/65 X |
| 2,511,096 | 6/1950 | Bate | 162/65 |
| 2,811,518 | 10/1957 | Mitchell et al. | 162/65 X |
| 3,652,385 | 3/1972 | Noreus et al. | 162/65 X |
| 3,668,063 | 6/1972 | Engstrom | 162/65 X |
| 3,691,008 | 9/1972 | Worster et al. | 162/65 |
| 3,701,712 | 10/1972 | Samuelson et al. | 162/65 |
| 3,764,464 | 10/1973 | Samuelson | 162/65 |
| 3,769,152 | 10/1973 | Samuelson et al. | 162/65 |

FOREIGN PATENT DOCUMENTS

| | | | |
|---|---|---|---|
| 895757 | 3/1972 | Canada . | |
| 2441440 | 3/1975 | Fed. Rep. of Germany | 162/65 |
| 147232 | 10/1916 | United Kingdom | 162/65 |
| 185421 | 9/1921 | United Kingdom | 162/65 |

OTHER PUBLICATIONS

Solano, "A Study of Oxygen-Soda Pulping on Eucalyptus Globulus"; Masters Thesis; Syracuse Univ., 6-1972.

Hata et al., "Oxygen-Alkali Semichemical Pulping of Wood Chips", *TAPPI*, vol. 58, No. 2, 2-1975.

Osawa et al., "The Action of Gaseous Reagents on Cellulosic Materials II", *TAPPI*, vol. 46, No. 2, Feb. 1963.

Makkonen et al., "Preliminary Studies of Peroxides and Oxygen Pretreatment in Alkaline Pulping", a paper presented at the 25th TAPPI Alkaline Pulping Conference of 1971.

*Primary Examiner*—S. Leon Bashore
*Assistant Examiner*—Steve Alvo

[57] ABSTRACT

A one-stage oxygen delignification system in which wood chips are first pressurized with oxygen and the oxygen allowed to reach equilibrium within the chips before the addition of cooking liquor. Cooking liquor is added to the chips while they are maintained under the pressurized oxygen. After the addition of cooking liquor under pressure, the oxygen pressure may be further raised. The cooking liquor may be at cooking temperature when added, or the slurry may be raised to cooking temperature after the liquor is added or after the additional pressure has been applied. The pressure may be pulsed by lowering and raising it during cooking.

41 Claims, 4 Drawing Figures

METHOD OF DELIGNIFYING WOOD CHIPS WITH OXYGEN BY ADDING COOKING LIQUOR UNDER PRESSURE

CROSS-REFERENCE TO RELATED APPLICATION

This application is a continuation of Ser. No. 717,957, filed Aug. 26, 1976 and now abandoned; which is a continuation-in-part of Ser. No. 646,809 filed Jan. 5, 1976 and now abandoned.

BACKGROUND OF THE INVENTION

1. Field of the Invention

The delignification of wood chips with oxygen and a cooking liquor.

2. Description of the Prior Art

An encomical nonpolluting pulping system would be an oxygen delignification system in which chips would be pulped in one cooking cycle, a one-stage system, in a relatively short time span. Unfortunately, a one-stage cook in an alkali-oxygen system results in a chip having an overcooked exterior and an undercooked interior creating a low yield in the weight of pulp that can be obtained from a given weight of wood chips. Theoretically, the yield from this process should be greater than the comparable yield from a kraft pulping process.

The reason for the overdelignification of the outer portion of a wood chip and the springwood within the chip and the underdelignification of the inner portion of the wood chip and the summerwood within the chip is that oxygen is a poorly soluble gas, and transfers through the cooking liquor and uniformly into the wood chips only with difficulty.

Samuelson, on page 1 of U.S. Pat. No. 3,764,464 issued Oct. 9, 1973, describes the problem and some methods that have been used in an attempt to overcome them. There have been several approaches to obtaining a uniform diffusion of oxygen through the wood chip. Makkonen et al, in "Preliminary Studies of Peroxide and Oxygen Pretreatment in Alkaline Pulping," a paper presented to the 25th TAPPI Alkaline Pulping Conference of 1971, and the article by Palenius, "Soda-Oxygen Cooking" Revue A.T.I.P., 28, 4 pp. 201–206 (1974), indicate there are three major methods being used.

The first was a pulping stage followed by an oxidative treatment as in present bleaching practice. This is the approach being used in the many patents and articles describing the oxygen bleaching process, or the two-stage oxygen pulping process. In this approach, the chip is fiberized prior to treatment with oxygen so there is no chip interior or exterior, only fibers. The chips normally are pulped using a standard process such as kraft or soda, and the chips are thereafter defiberized as by being blown from the high pressure digester into a low pressure blow tank or by a mechanical refining step. Illustrative of the many patents and abstracts describing these processes are Robert et al U.S. Pat. No. 3,384,533 issued May 21, 1968, and Worster et al U.S. Pat. No. 3,691,008 issued Sept. 12, 1972.

The second method is a combined oxidative pulping system. These are the one-stage systems in which wood chips are pulped in the presence of oxygen and a cooking liquor. In this system, the conditions are manipulated in an attempt to obtain the diffusion of the oxygen uniformly through the chip. Typically, these manipulations take the form of low cooking temperatures and very long, and therefore expensive, cooking times to obtain a mild cook throughout the chip, and diffusion throughout the chip; a continuous infusion of chemicals and oxygen into the cooking liquor in order to maintain the cooking liquor at its initial conditions; and, most recently, mechanically removing the cooked fibers from the chip and the cooking liquor to create continually a new outer chip surface. Typical patents and articles describing the first two approaches are: Chang et al, "Delignification of High-Yield Pulp with Oxygen and Alkali—Southern Pine Kraft Pulp," TAPPI, January 1973, Vol. 56, No. 1, pp. 97–100; Shchyegolyev et al, "The Influence of Molecular Oxygen Upon the Process of Delignification," Bumazhnaya Promushlyennos, 1966, No. 5, 6–7; Samuelson, U.S. Pat. No. 3,701,712, issued Oct. 31, 1972; Croon et al, U.S. Pat. No. 3,652,388, issued Mar. 28, 1972; Samuelson et al, U.S. Pat. No. 3,769,152, issued Oct. 30, 1973; Harris, U.S. Pat. No. 2,673,148, issued Mar. 23, 1954; Nowakowski, "The Role of Oxygen at the Alkaline Digestion of Softwood Under Pressure," Zeszyty Problemowe Postepow Nauk Rolniczych No. 52 (1965), pp. 107–126; Minor et al, "Factors Influencing the Properties of Oxygen Pulps from Softwood Chips," TAPPI, Vol. 57, No. 5, May 1974, pp. 120–122 and paper presented at 1973 TAPPI Alkaline Pulping Conference, pp. 52–56; Solano, "A Study of Oxygen—Soda Pulping on Eucalyptus Globulus," Masters thesis, June 1972, Syracuse University; and Worster et al, Canadian Pat. No. 895,757, issued Mar. 21, 1972. The above patents and articles indicates no general trend in methods of treating wood chips with oxygen in one stage. They seem to indicate different results using similar conditions. For example, several advise that high initial concentrations of oxygen are detrimental to the pulping process, but one indicates that with hardwood chips good results were obtained with high initial chemical and oxygen concentrations.

The third approach, the use of mechanical means to remove the outer surface of the chip as it reacts, is described in Samuelson, German Patent Disclosure No. 2,441,440, disclosed Mar. 27, 1975, entitled "Process for Pulping of Wood." Various means for removing the outer fibers from the chips and removing these fibers from the pulping liquor are described.

A third method is an oxidative pretreatment followed by pulping. This is described in the above Makkonen and Palenius articles and is clarified by Karna, Johansen and Sarkanen. This method uses both a cooking liquor and oxygen at the same time, even though it is called an oxygen-alkali system. It has the same diffusion problems as the first approach. Its purpose is to stabilize the carbohydrates. Another approach described in Richter, U.S. Pat. No. 1,831,032, issued Mar. 30, 1928, is to cook the chips in water with an oxygen over-pressure.

Sunds British Pat. No. 1,360,839 discloses the pulp falling through a gas and coming to rest in a column having a consistency of around 25–30%. The pulp had been mixed with 3–5% sodium hydroxide prior to the experiments. It appears that the column of pulp sits in oxygen and the consistency level is required so that combustion does not occur. Mitchell et al, U.S. Pat. No. 2,811,518, also requires that the pulp treated in the alkaline-oxygen stage be loose, fluffy and not be immersed in liquor. It is noted in Col. 3, lines 26–36.

All these methods and approaches contact the chips with the cooking liquor before or at the time of application of oxygen.

SUMMARY OF THE INVENTION

It occurred to the inventor to question the need for placing the chips in the cooking liquor before or with the application of oxygen if oxygen diffusion was a problem. It occurred to him there may be a way of causing reaction on the interior of the chip instead of the exterior of the chip. He did this by application of oxygen to the chips prior to the addition of cooking liquor. This causes the oxygen to be available within the chip and the oxygen cooking liquor interface to be within the chip. It is no longer a problem to bring oxygen to the cooking site through the cooking liquor. The oxygen is at the site and the rate of diffusion of the oxygen in the liquor is less important.

He further determined that pulsating the pressure during delignification would give good results because fresh liquor would constantly be carried to the digestion sites through the expansion and contraction of oxygen within the chips because of the change in pressure.

DESCRIPTION OF THE PREFERRED EMBODIMENTS

Figure 1:
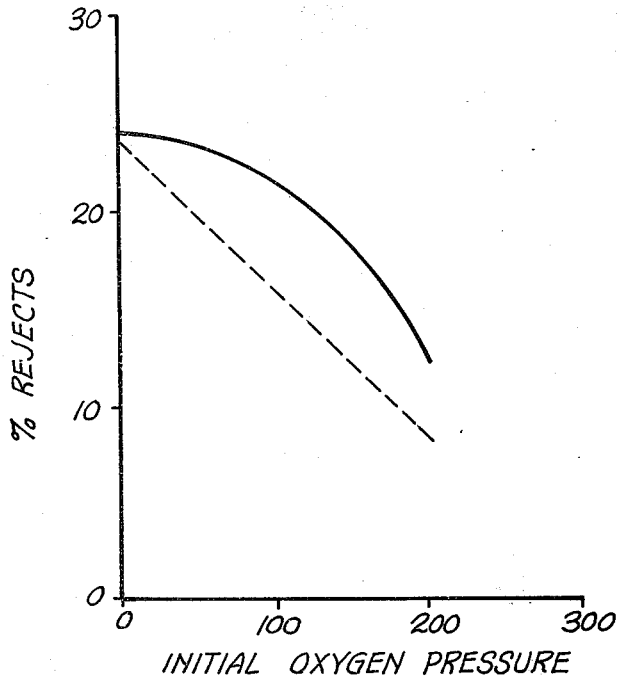
FIGS. 1–4 are graphs showing the results of various experiments.

The purpose of any pulping system is to obtain the best yield from the wood chips. Yield may be measured in two ways. The first is on a weight basis, and is the measure of carbohydrates and lignin returned per unit of wood. Screened yield is closely related and proportional to this chemical return. A high screened yield means the chemical return is high and a low screened yield means the chemical return is low. The second measurement of yield is a fiber yield basis. Rejects are related to and inversely proportional to the fiber yield. A high reject level means there is a low fiber return and a low reject level means there is a high fiber return. The ideal situation would be one in which there is a high chemical return and a high fiber return indicated by a high screened yield and low rejects.

All pulping systems require a trade-off between the two yields. Normally, conditions which give a low reject level will generally cause solution of some of the chemicals which in turn give a lower chemical yield, and conditions which give a higher chemical yield give a lower fiber yield.

The present system has been used with softwood chips, either Douglas fir or hemlock. These are different wood chips to pulp so the system is considered useful with any species of chip.

The chips are placed in an autoclave and a vacuum normally is drawn on the chip. Oxygen is next applied to the chips. The oxygen pressure should be great enough to cause oxygen to enter the chips. It may be from 50 pounds per square inch to the limits of the equipment being used. The preferred range is 100 to 300 pounds per square inch gauge.

The oxygen is allowed to reach equilibrium within the chip so that the passage of oxygen from the atmosphere surrounding the chip into the chip reaches a steady state. The amount of time required to reach equilibrium will depend on the moisture content of the chip. The greater the moisture content the longer the time required for the oxygen to transfer through the moisture layer on the chip and into the chip. The time will range from 1–2 minutes at 6–9% moisture content to 1 hour at 35% moisture content. The moisture content is the weight of water per unit weight of bone dry chips expressed as a percentage. The usual moisture content of chips is between 40 and 60%. Consequently, the chips must be dried. Again the optimum moisture content is a trade-off between the cost of drying the chips and the cost of allowing the equipment to stand idle while the oxygen is reaching equilibrium.

After holding the chips at the oxygen pressure for a time sufficient to allow the oxygen in the chips to reach equilibrium with the oxygen outside the chips, the cooking liquor is added under a pressure at least equal to the oxygen prepressure. The upper pressure limit on the cooking liquor will again depend on the equipment. Pressures up to 700 psig have been tried. In some experiments the cooking liquor pressure has been 400 psi greater than the oxygen prepressure. The cooking liquor should be alkaline. Exemplary are the alkaline earth metal hydroxides, borates, carbonates or bicarbonates such as sodium hydroxide, sodium borate, sodium carbonate or sodium bicarbonate. The preferred chemical is sodium carbonate. The concentration of the chemical, based on the weight of oven dry wood, is 5% or greater. The upper limit of concentration is determined by the chemical cost and rate of carbohydrate degradation. The preferred range is 25 to 35% chemical on oven dry wood.

Additional oxygen may be applied to the solution to increase the pressure. The total oxygen pressure, the original pressure or prepressure and pressure increase, should at least equal the cooking liquor pressure. The preferred pressure increase is at least equal to the original oxygen pressure. With the preferred original pressure, the preferred increase is between 100 to 300 psi, and the total pressure on the system, depending on the original pressure and the additional pressure, is from 100 to 600 psig.

The temperature of the system is raised to 100° to 180° C., preferably 140° C., further increasing the pressure, and the chips are cooked for an appropriate length of time. This is usually 2–4 hours; 3 hours is preferred. The point at which the cooking liquor is brought to cooking temperature is not material. It may be at cooking temperature when applied to the chips. During the cook, the pressure may be lowered and raised to expand and contact the oxygen within the chip, replacing the old cooking liquor within the chip with fresh cooking liquor. The pressure decrease and increase normally is equal to the initial oxygen pressure increase.

Typical examples are as follows:

EXAMPLE 1

A. Air dried Douglas fir chips (6–7% moisture content) are added to a high pressure autoclave.

B. After sealing, the pressure is reduced in the autoclave with vacuum.

C. The system pressure is brought to 200 psig with oxygen.

D. One to two minutes after reaching pressure, liquor (33% $Na_2CO_3$ on wood, liquor to wood ratio 10:1) is added under pressure and additional oxygen is added to raise the pressure an additional 300 psi ($\Delta P$) to bring the final initial system pressure to 500 psig.

E. The temperature is raised to 140° C., further raising the pressure to the operating pressure, and held for three hours. At temperature and on the hour, oxygen pressure is quickly released and reapplied to reduce the system pressure by 300 psi and then raise it back to operating pressure. This is called pressure pulsation.

F. This results in a pulp with a screened yield of 45.6%, a reject level of 10.3% to give a total yield of 55.9%.

EXAMPLE 2

A. The process is the same as in Example 1 except that pressure pulsation was not used.

B. This resulted in a screened yield of 45.3, a reject level of 13.6% for a total yield of 58.9%.

EXAMPLE 3

A. This process is the same as in Example 2 except the time was reduced to two hours.

B. This resulted in a screened yield of 38.7%, a reject level of 22.6% for a total yield of 61.3%.

EXAMPLE 4

A. This process is the same as in Example 2 except the time was lengthened to four hours.

B. This resulted in a screened yield of 45.7%, a reject level of 9.0%, for a total yield of 54.7%.

EXAMPLE 5

A. This process is the same as Example 2 except the temperature was raised to 150° C.

B. This resulted in a screened yield of 40.9%, a reject level of 9.9%, for a total yield of 50.8%.

EXAMPLE 6

A. This process is the same as in Example 4 except the temperature was reduced to 130° C.

B. This resulted in a screened yield of 45.7%, a reject level of 13.8%, for a total yield of 59.5%.

EXAMPLE 7

A. This process is the same as in Example 4 except that hemlock chips were substituted for Douglas fir chips.

B. This resulted in a screened yield of 44.7%, a reject level of 4.5%, for a total yield of 49.2%.

EXAMPLE 8

A. This process is the same as in Example 2 except prepressurization pressure was 300 psig and $\Delta P$ was 200 psig.

B. This resulted in a screened yield of 44.5%, a reject level of 11.9%, for a total yield of 56.4%.

EXAMPLE 9

A. This process is the same as in Example 8 except $\Delta P$ was raised to 400 psig.

B. This resulted in a screened yield of 46.3%, a reject level of 10.0%, for a total yield of 56.3%.

EXAMPLE 10

A. This process is the same as in Example 9 except $\Delta P$ was reduced to 300 psig.

B. This resulted in a screened yield of 44.8%, a reject level of 11.0%, for a total yield of 55.8%.

EXAMPLE 11

A. A cook was made at 140° C. using 33.1% sodium carbonate on wood for a cooking time of three hours. The liquor to wood ratio was 10:1. The cook was a standard one-stage oxygen pulping cook in which the cooking liquor and oxygen were added simultaneously. The pressure prior to heating was 500 psig.

B. This resulted in a screened yield of 40%, a reject level of 15.8%, and a total yield of 55.8%.

EXAMPLE 12

A. One hundred oven dry grams of air-dried hemlock chips were charged in a high-pressure autoclave.

B. After sealing, the autoclave was evacuated and cooking liquor (33.1 grams of sodium carbonate per thousand milliliters of water) was added, and the pressure raised to 300 psig with oxygen.

C. The temperature was raised to 140° C. in 70 minutes, raising the pressure to the operating pressure, and held for four hours.

D. After blowing off the liquor, the chips were disintegrated for five minutes and then screened.

E. The pulp and rejects were soaked in a 1% acetic acid solution and then washed with water.

F. On an oven dry wood basis, the screened yield of 33.8%, the reject level of 23.5%, and the total yield of 57.3%.

EXAMPLE 13

A. Hemlock chips were air dried to 22% relative humidity to yield a final moisture content of 9%.

B. One hundred OD grams (109 grams at 9% moisture content) were introduced into a one-gallon high-pressure autoclave equipped with stirring.

C. After sealing, the pressure was evacuated and then pressurized to 100 psig with oxygen.

D. One to two minutes after reaching pressure, cooking liquor (33.1 grams of sodium carbonate in 1,000 milliliters of water) was introduced under pressure and the pressure raised to a final initial pressure of 300 psig with oxygen.

E. The temperature was raised to 140° C. in 70 minutes, raising the operating pressure, and held for four hours.

F. After blowing off the liquor, the chips were disintegrated using a British disintegrator for five minutes and screened through a laboratory flat screen.

G. The pulp and rejects were soaked in a 1% acetic acid solution and then washed with water.

H. Rejects were dried in total and an aliquote of the pulp was dried at 105° C. for 24 hours to determine yield. On an oven dry wood basis, the screened yield was 33.8%, the rejects were 20.8%, for a total yield of 54.6%.

EXAMPLE 14

A. The process is the same as in Example 13 except that the initial pressure was 200 psig and the final initial pressure 400 psig.

B. On an oven dry wood basis, the screened yield was 41.5%, the reject level was 12.1%, for a total yield of 53.6%.

EXAMPLE 15

A. The process was the same as in Example 13 except that every half hour the operating pressure was quickly dropped 200 psi and then raised 200 psi with oxygen.

B. On an oven dry wood basis, the screened yield was 36.5%, the rejects 15.3%, for a total yield of 51.8%.

EXAMPLE 16

A. The process was the same as Example 14 except that every half hour the pressure was quickly dropped 200 psi below operating pressure and then raised back to operating pressure with oxygen.

B. On an oven dry wood basis, the screened yield was 44.6%, rejects 8.4%, for a total yield of 53.0%.

EXAMPLE 17

A. The process was the same as Example 13 except that initial pressure was 200 psig and the final initial pressure 300 psig.

B. On an oven dry wood basis, the screened yield was 34.8%, the rejects 18.9%, for a total yield of 52.8%.

EXAMPLE 18

A. The process was the same as Example 17 except that the final initial pressure was 450 psig.

B. On an oven dry wood basis, the screened yield was 43.1%, rejects were 6.1%, for a total yield of 49.2%.

EXAMPLE 19

A. Hemlock chips were pressured to 200 psig with oxygen and, after serveral minutes to allow the oxygen to reach equilibrium within the chip, cooking liquor was added under pressure. Additional oxygen was added to increase the pressure another 300 psig (ΔP) to cause the final initial pressure to be 500 psig. The liquor and chips were then raised to a temperature of 140° and cooked at temperature for two hours.

B. The cook resulted in a screened yield of 39.8%, a reject yield of 15.8%, for a total yield of 55.6%.

EXAMPLE 20

A. The conditions were the same as for Example 19 except that once an hour the pressure was quickly dropped 300 psi and raised 300 psi.

B. The screened yield was 41.7%, the rejects 17.6%, and the total yield 59.3%.

EXAMPLE 21

A. The conditions were the same as Example 20 except that pressure pulsation occurred every half hour.

B. This resulted in a screened yield of 36.8%, a reject level of 22.1%, and a total yield of 58.9%.

EXAMPLE 22

A. The conditions were the same as Example 20 except that pressure pulsation occurred every 15 minutes.

B. This resulted in a screened yield of 34.9%, a reject level of 23.0%, and a total yield of 57.9%.

EXAMPLE 23

A. The conditions were the same as Example 20 except that the pressure pulsation occurred every 5 minutes.

B. The screened yield was 38.1%, the reject level was 21.8%, and the total yield was 59.9%.

Table I lists the results of the above experiments, and Tables II through XVII compare various parameters within the experiments.

Table II indicates the change in yield as the length of cook is increased, and it may be seen that increasing the cook from two to three hours causes a dramatic increase both in the chemical and fiber yield, indicated by the increase in screened yield and the decrease in rejects. There is a further decrease in rejects as the time is increased to four hours. The preferred cooking time is about three hours.

Tables III and IV compare the cooking temperature. As the temperature increases from 130° to 140°, there is an increase in fiber yield indicated by the decrease in rejects; but if the temperature is increased from 140° and 150°, there is a decrease in chemical yield indicated by the decrease in screened yield, as well as an increase in fiber yield. Consequently, the preferred temperature is approximately 140° C. for an optimum chemical and fiber yield.

Tables V–VII compare a change in the initial oxygen prepressure. There is a dramatic increase in both chemical and fiber yield, indicated by the increase in screened yield and the decrease in rejects, when the prepressure is raised from 0 to 200 psi or from 100 to 200 psi, as shown in Tables VI and VII, but there is a decrease in chemical yield, indicated by the decrease in screened yield, and little increase in fiber yield, indicated by the small decline in rejects, when the prepressure is raised from 200 to 300 psig. From this it appears that a prepressure of around 200 psig is optimum. This is the pressure required for a void volume of 50% in the chips.

Tables VIII and IX compare the change in the ΔP, the increase in oxygen pressure after the addition of cooking liquor. This pressure forces the liquor into the chip. Both tables show a trend of increased chemical and fiber yield, indicated by the increase in screened yield and the decrease in rejects, as the ΔP is increased. Table IX shows a dramatic increase in chemical and fiber yield as the ΔP approaches the prepressure value of 200 psi, and a continued dramatic increase in yield as ΔP exceeds this prepressure value. The results are not as startling if the prepressure is higher. This is shown in Table VIII. It appears that the higher the ΔP the better the yield. The capital costs of the pressurized equipment become a limiting factor. However, it can be seen from the tables that the ΔP should be equal to or greater than the prepressure, and it appears that a ΔP of approximately 300 psi is optimum from an operating and a capital cost standpoint.

Tables X and XI compare changes both in prepressure and ΔP, Table X for Douglas fir and Table XI for hemlock. From these again it may be seen that there is dramatic increase in yield as the prepressure is around 200 psig and ΔP equals the prepressure. This may especially be noted in Examples 17 and 14 in Table XI.

Tables XII and XIII compare results if pressure pulsation is used. It appears that pressure pulsation is more useful at lower pressures than at higher pressures.

Table XVI compares results at different pressure pulsation cycles. It appears that there is an increase in yield at one cycle per hour and again at greater than 12 cycles per hour, and for some reason poor results between these numbers. Consequently, the optimum appears to be around one cycle per hour.

Figure 2:
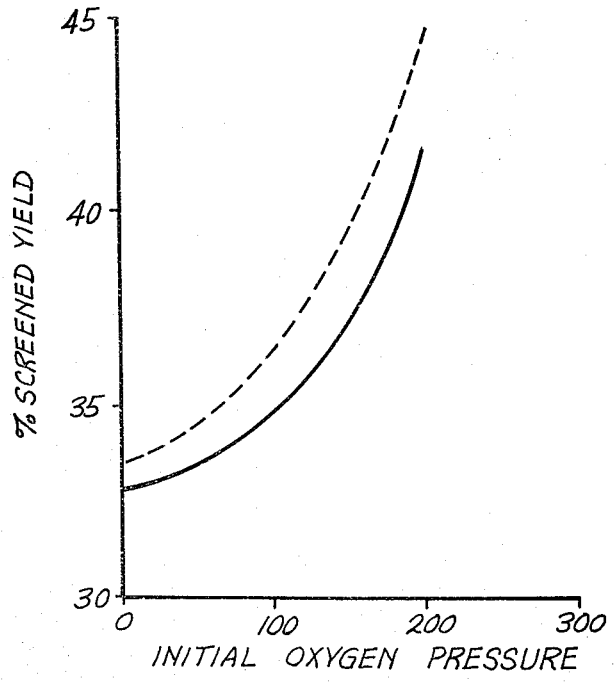

FIGS. 1 and 2 plot certain results from Examples 12–16, given in Tables XV and XVI. FIG. 1 plots the percent rejects and FIG. 2 the screened yield in relationship to the original oxygen pressure. The solid line plots the results of Examples 12–14 without pulsation and the dotted line, Examples 12, 15, and 16 with pulsation. Example 12 is a control. The results from Examples 12–14 indicate that rejects were reduced by 50% and the screened yield increased from 34% to 42% by the use of prepressurization and an increase in the original pressure from 0 to 200 psig. The results of Examples 12, 15, and 16 indicate that rejects were lower and screened yield increased with pressure pulsation.

Figure 3:
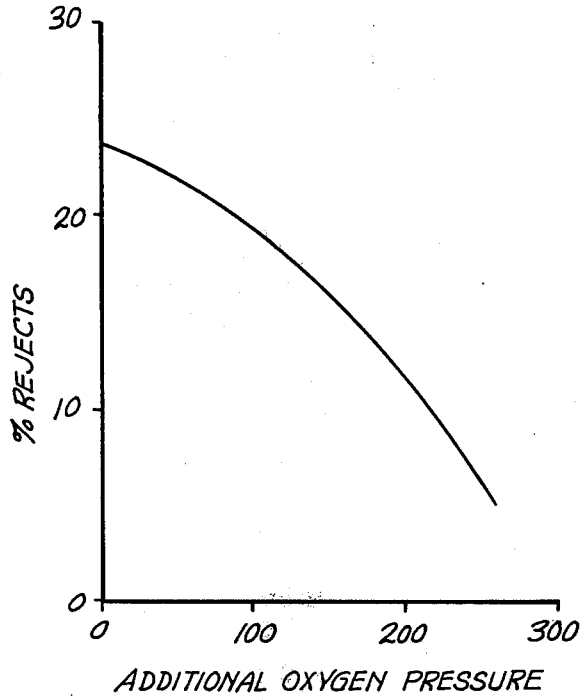
Figure 4:
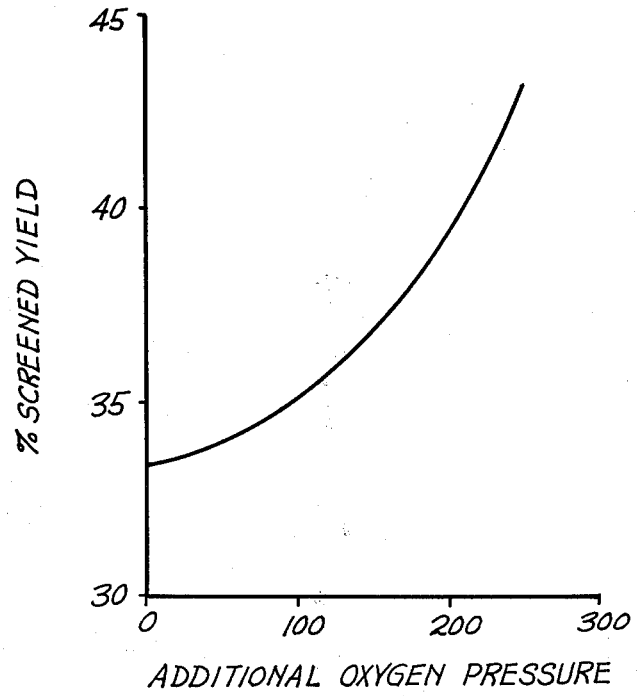

FIGS. 3 and 4 plot certain results from Examples 12, 17, 14, and 18 respectively, given in Table XVII. FIG. 3 plots the percent rejects, and FIG. 4 the screened yield in relationship to the additional increase of oxygen pressure after the addition of cooking liquor. The rejects were reduced 75% as the additional pressure was increased to 250 psi, and the screened yield was increased from 34% to 43% over the same pressure differential.

TABLE I

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 1 | D. Fir | 200 | 300 | 500 | 3 | 140 | 1 | 300 | 45.6 | 10.3 | 55.9 |
| 2 | D. Fir | 200 | 300 | 500 | 3 | 140 | 0 | — | 45.3 | 13.6 | 58.9 |
| 3 | D. Fir | 200 | 300 | 500 | 2 | 140 | 0 | — | 38.7 | 22.6 | 61.3 |
| 4 | D. Fir | 200 | 300 | 500 | 4 | 140 | 0 | — | 45.7 | 9.0 | 54.7 |
| 5 | D. Fir | 200 | 300 | 500 | 3 | 150 | 0 | — | 40.9 | 9.9 | 50.8 |
| 6 | D. Fir | 200 | 300 | 500 | 4 | 130 | 0 | — | 45.7 | 13.8 | 59.5 |
| 7 | Hemlock | 200 | 300 | 500 | 4 | 140 | 0 | — | 44.7 | 4.5 | 49.2 |
| 8 | D. Fir | 300 | 200 | 500 | 3 | 140 | 0 | — | 44.5 | 11.9 | 56.4 |
| 9 | D. Fir | 300 | 400 | 700 | 3 | 140 | 0 | — | 46.3 | 10.0 | 56.3 |
| 10 | D. Fir | 300 | 300 | 600 | 3 | 140 | 0 | — | 44.8 | 11.0 | 55.8 |
| 11 | D. Fir | 0 | 500 | 500 | 3 | 140 | 0 | — | 40.0 | 15.8 | 55.8 |
| 12 | Hemlock | 0 | 300 | 300 | 4 | 140 | 0 | — | 33.8 | 23.5 | 57.3 |
| 13 | Hemlock | 100 | 200 | 300 | 4 | 140 | 0 | — | 33.8 | 20.8 | 54.6 |
| 14 | Hemlock | 200 | 200 | 400 | 4 | 140 | 0 | — | 41.5 | 12.1 | 53.6 |
| 15 | Hemlock | 100 | 200 | 300 | 4 | 140 | 2 | 200 | 36.5 | 15.3 | 51.8 |
| 16 | Hemlock | 200 | 200 | 400 | 4 | 140 | 2 | 200 | 44.6 | 8.4 | 53.0 |
| 17 | Hemlock | 200 | 100 | 300 | 4 | 140 | 0 | — | 34.8 | 18.9 | 52.8 |
| 18 | Hemlock | 200 | 250 | 450 | 4 | 140 | 0 | — | 43.1 | 6.1 | 49.2 |
| 19 | Hemlock | 200 | 300 | 500 | 2 | 140 | 0 | — | 39.8 | 15.8 | 55.6 |
| 20 | Hemlock | 200 | 300 | 500 | 2 | 140 | 1 | 300 | 41.7 | 17.6 | 59.3 |
| 21 | Hemlock | 200 | 300 | 500 | 2 | 140 | 2 | 300 | 36.8 | 22.1 | 58.9 |
| 22 | Hemlock | 200 | 300 | 500 | 2 | 140 | 4 | 300 | 34.9 | 23.0 | 57.9 |
| 23 | Hemlock | 200 | 300 | 500 | 2 | 140 | 12 | 300 | 38.1 | 21.8 | 59.9 |

TABLE II

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 3 | D. Fir | 200 | 300 | 500 | 2 | 140 | 0 | — | 38.7 | 22.6 | 61.3 |
| 2 | D. Fir | 200 | 300 | 500 | 3 | 140 | 0 | — | 45.3 | 13.6 | 58.9 |
| 4 | D. Fir | 200 | 300 | 500 | 4 | 140 | 0 | — | 45.7 | 9.0 | 54.7 |

TABLE III

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 6 | D. Fir | 200 | 300 | 500 | 4 | 130 | 0 | — | 45.7 | 13.8 | 59.5 |
| 4 | D. Fir | 200 | 300 | 500 | 4 | 140 | 0 | — | 45.7 | 9.0 | 54.7 |

TABLE VI

| Example | Wood | Pre-Pressure Psig | ΔP Psi | Final Initial Pressure Psig | time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 2 | D. Fir | 200 | 300 | 500 | 3 | 140 | 0 | — | 45.3 | 13.6 | 58.9 |
| 5 | D. Fir | 200 | 300 | 500 | 3 | 150 | 0 | — | 40.9 | 9.9 | 50.8 |

TABLE V

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 2 | D. Fir | 200 | 300 | 500 | 3 | 140 | 0 | — | 45.3 | 13.6 | 58.9 |
| 10 | D. Fir | 300 | 300 | 600 | 3 | 140 | 0 | — | 44.8 | 11.0 | 55.8 |

TABLE VI

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 12 | Hemlock | 0 | 300 | 300 | 4 | 140 | 0 | — | 33.8 | 23.5 | 57.3 |
| 7 | Hemlock | 200 | 300 | 500 | 4 | 140 | 0 | — | 44.7 | 4.5 | 49.2 |

TABLE VII

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 13 | Hemlock | 100 | 200 | 300 | 4 | 140 | 0 | — | 33.8 | 20.8 | 54.6 |
| 14 | Hemlock | 200 | 200 | 400 | 4 | 140 | 0 | — | 41.5 | 12.1 | 53.6 |

TABLE VIII

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 8 | D. Fir | 300 | 200 | 500 | 3 | 140 | 0 | — | 44.5 | 11.9 | 56.4 |
| 10 | D. Fir | 300 | 300 | 600 | 3 | 140 | 0 | — | 44.8 | 11.0 | 55.8 |
| 9 | D. Fir | 300 | 400 | 700 | 3 | 140 | 0 | — | 46.3 | 10.0 | 56.3 |

TABLE IX

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 17 | Hemlock | 200 | 100 | 300 | 4 | 140 | 0 | — | 34.8 | 18.9 | 52.8 |
| 14 | Hemlock | 200 | 200 | 400 | 4 | 140 | 0 | 13 | 41.5 | 12.1 | 53.6 |
| 18 | Hemlock | 200 | 250 | 450 | 4 | 140 | 0 | — | 43.1 | 6.1 | 49.2 |
| 7 | Hemlock | 200 | 300 | 500 | 4 | 140 | 0 | — | 44.7 | 4.5 | 49.2 |

TABLE X

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 11 | D. Fir | 0 | 500 | 500 | 3 | 140 | 0 | — | 40.0 | 15.8 | 55.8 |
| 2 | D. Fir | 200 | 300 | 500 | 3 | 140 | 0 | — | 45.3 | 13.6 | 58.9 |
| 8 | D. Fir | 300 | 200 | 500 | 3 | 140 | 0 | — | 44.5 | 11.9 | 56.4 |

TABLE XI

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 12 | Hemlock | 0 | 300 | 300 | 4 | 140 | 0 | — | 33.8 | 23.5 | 57.3 |
| 13 | Hemlock | 100 | 200 | 300 | 4 | 140 | 0 | — | 33.8 | 20.8 | 54.6 |
| 17 | Hemlock | 200 | 100 | 300 | 4 | 140 | 0 | — | 34.8 | 18.9 | 52.8 |
| 14 | Hemlock | 200 | 200 | 400 | 4 | 140 | 0 | — | 41.5 | 12.1 | 53.6 |

TABLE XII

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 13 | Hemlock | 100 | 200 | 300 | 4 | 140 | 0 | — | 33.8 | 20.8 | 54.6 |
| 15 | Hemlock | 100 | 200 | 300 | 4 | 140 | 2 | 200 | 36.5 | 15.3 | 51.8 |

TABLE XIII

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 14 | Hemlock | 200 | 200 | 400 | 4 | 140 | 0 | — | 41.5 | 12.1 | 53.6 |
| 16 | Hemlock | 200 | 200 | 400 | 4 | 140 | 2 | 200 | 44.6 | 8.4 | 53.0 |

TABLE XIV

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 19 | Hemlock | 200 | 300 | 500 | 2 | 140 | 0 | — | 39.8 | 15.8 | 55.6 |
| 20 | Hemlock | 200 | 300 | 500 | 2 | 140 | 1 | 300 | 41.7 | 17.6 | 59.3 |
| 21 | Hemlock | 200 | 300 | 500 | 2 | 140 | 2 | 300 | 36.8 | 22.1 | 58.9 |
| 22 | Hemlock | 200 | 300 | 500 | 2 | 140 | 4 | 300 | 34.9 | 23.0 | 57.9 |
| 23 | Hemlock | 200 | 300 | 500 | 2 | 140 | 12 | 300 | 38.1 | 21.8 | 59.9 |

TABLE XV

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 12 | Hemlock | 0 | 300 | 300 | 4 | 140 | 0 | — | 33.8 | 23.5 | 57.3 |
| 13 | Hemlock | 100 | 200 | 300 | 4 | 140 | 0 | — | 33.8 | 20.8 | 54.6 |
| 14 | Hemlock | 200 | 200 | 400 | 4 | 140 | 0 | — | 41.5 | 12.1 | 53.6 |

TABLE XVI

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 12 | Hemlock | 0 | 300 | 300 | 4 | 140 | 0 | — | 33.8 | 23.5 | 57.3 |
| 15 | Hemlock | 100 | 200 | 300 | 4 | 140 | 2 | 200 | 36.5 | 15.3 | 51.8 |
| 16 | Hemlock | 200 | 200 | 400 | 4 | 140 | 2 | 200 | 44.6 | 8.4 | 53.0 |

TABLE XVII

| Example | Wood | Pre-Pressure Psig | ΔP Psi | Final Initial Pressure Psig | Time Hours | Temp. °C. | Pressure Pulse Cycles/Hour | Pressure Pulse Pressure Change Psi | Screened Yield % | Reject % | Total Yield % |
|---|---|---|---|---|---|---|---|---|---|---|---|
| 12 | Hemlock | 0 | 300 | 300 | 4 | 140 | 0 | — | 33.8 | 23.5 | 57.3 |
| 17 | Hemlock | 200 | 100 | 300 | 4 | 140 | 0 | — | 34.8 | 18.9 | 52.8 |
| 14 | Hemlock | 200 | 200 | 400 | 4 | 140 | 0 | — | 41.5 | 12.1 | 53.6 |
| 18 | Hemlock | 200 | 250 | 450 | 4 | 140 | 0 | — | 43.1 | 6.1 | 49.2 |

What is claimed is:

1. The process of delignifying wood chips using oxygen and a cooking liquor comprising placing wood chips having a moisture content of up to 35% into a cooking vessel, prior to the addition of cooking liquor, placing said chips in a gaseous atmosphere in which the reactive gas consists essentially of oxygen at a pressure of at least 50 psig, maintaining said chips in chip form in said oxygen atmosphere for ½ to 60 minutes, while continuing to maintain said oxygen pressure on said chips, adding said cooking liquor to said chips, said liquor being under a pressure at least equal to said oxygen pressure, cooking said chips.

2. The process of claim 1 in which said oxygen is at a pressure of 100 to 300 psig.

3. The process of claim 2 in which said oxygen is at a pressure of approximately 200 psig.

4. The process of claim 3 in which the oxygen pressure is increased after the addition of the cooking liquor so that the oxygen pressure after increase is greater than the oxygen pressure before the addition of the cooking liquor.

5. The process of claim 4 in which said pressure increase is at least 200 psi.

6. The process of claim 2 in which said oxygen pressure is increased after the addition of the cooking liquor.

7. The process of claim 6 in which the oxygen pressure after increase is at least equal to said liquor pressure.

8. The process of claim 7 in which said pressure increase is at least equal to said original oxygen pressure.

9. The process of claim 8 in which the chips are cooked at a temperature in the range from 100°-180° C.

10. The process of claim 9 in which said temperature is approximately 140° C.

11. The process of claim 10 in which said delignification takes place in a time of between two and four hours after reaching said temperature.

12. The process of claim 11 in which said time is approximately three hours.

13. The process of claim 9 in which said delignification takes place in a time of from two to four hours after reaching said temperature.

14. The process of claim 13 in which said time is approximately three hours.

15. The process of claim 8 in which said pressure is lowered and raised while said chips are being cooked.

16. The process of claim 15 in which said pressure lowering and raising occurs at approximately regular intervals.

17. The process of claim 16 in which said regular intervals occur in the range of 1–2 per hour.

18. The process of claim 16 in which said regular intervals occur greater than 12 times per hour.

19. The process of claim 16 in which the pressure is lowered approximately the same amount as the pressure increase.

20. The process of claim 15 in which said pressure is lowered approximately the same amount as said pressure increase.

21. The process of claim 8 in which said cooking liquor is an alkaline cooking liquor.

22. The process of claim 21 in which the cooking liquor is selected from the group consisting of alkaline earth metal hydroxides, borates, carbonates and bicarbonates.

23. The process of claim 21 in which the amount of chemical used is in a range of 25–35% of the weight of the oven dry wood.

24. The process of claim 1 in which said oxygen pressure is increased after the addition of the cooking liquor so that the oxygen pressure is greater than the oxygen pressure before the addition of the cooking liquor.

25. The process of claim 24 in which the oxygen pressure after increase is at least equal to said liquor pressure.

26. The process of claim 25 in which said pressure increase is at least equal to said original oxygen pressure.

27. The process of claim 26 in which the chips are cooked at a temperature in the range from 100–180° C.

28. The process of claim 27 in which said temperature is approximately 140° C.

29. The process of claim 28 in which said delignification takes place in a time of between two and four hours after reaching said temperature.

30. The process of claim 29 in which said time is approximately three hours.

31. The process of claim 27 in which said delignification takes place in a time of from two to four hours after reaching said temperature.

32. The process of claim 31 in which said time is approximately three hours.

33. The process of claim 26 in which said pressure is lowered and raised while said chips are being cooked.

34. The process of claim 33 in which said pressure lowering and raising occurs at approximately regular intervals.

35. The process of claim 34 in which said regular intervals occur in the range of 1–2 per hour.

36. The process of claim 34 in which said regular intervals occur greater than 12 times per hour.

37. The process of claim 34 in which the pressure is lowered approximately the same amount as the pressure increase.

38. The process of claim 33 in which said pressure is lowered approximately the same amount as said pressure increase.

39. The process of claim 26 in which said cooking liquor is an alkaline cooking liquor.

40. The process of claim 39 in which the cooking liquor is selected from the group consisting of alkaline earth metal hydroxides, borates, carbonates and bicarbonates.

41. The process of claim 40 in which the amount of chemical used is in a range of 25–35% of the weight of the oven dry wood.

* * * * *